United States Patent [19]

Huang

[11] Patent Number: 5,025,506

[45] Date of Patent: Jun. 25, 1991

[54] ONE PIECE MASK BODY HAVING VERTICALLY STITCHED NOSE ACCOMMODATING PORTION

[76] Inventor: James R. C. Huang, 4th Fl. No. 18, Alley 3, Lane 94, Tai Chih Street, Taipei, Taiwan

[21] Appl. No.: 413,615

[22] Filed: Sep. 28, 1989

[51] Int. Cl.[5] ..... A62B 18/02

[52] U.S. Cl. ..... 2/206; 128/206.19; 128/863; 128/206.16

[58] Field of Search ..... 2/206, 9, DIG. 7; 128/863, 206.19, 206.28, 206.12, 201.15, 206.13, 206.16, 206.21; 446/27

[56] References Cited

U.S. PATENT DOCUMENTS

| | | | |
|---|---|---|---|
| 1,523,884 | 1/1925 | Leduc | 128/863 |
| 3,038,470 | 6/1962 | Campbell | 2/9 X |
| 3,288,138 | 11/1966 | Sachs | 128/863 |
| 3,500,825 | 3/1970 | Anderson et al. | 128/206.19 X |
| 3,971,369 | 7/1976 | Aspelin et al. | 128/206.19 |

FOREIGN PATENT DOCUMENTS

| | | | |
|---|---|---|---|
| 0232072 | 8/1959 | Australia | 2/206 |
| 1220851 | 1/1960 | France | 128/863 |

*Primary Examiner*—Peter Nerbun

*Attorney, Agent, or Firm*—Shoemaker and Mattare, Ltd.

[57] ABSTRACT

A face mask able to appropriately cover the nose is made of a sheet of flexible material which forms the body of the mask. The upper portion of the body is so folded that two opposing sides of the folded upper portion are folded downward and decline toward the center of the body of the mask to positions whereat each of the two sides of the folded upper portion are stitched to the mask body at an appropriate distance apart, thereby forming an inverted, concave, V-shaped flange which provides a space which accommodates the nose of the wearer, without leaving a gap between the mask and the face of the wearer at each side of the nose.

1 Claim, 3 Drawing Sheets

ONE PIECE MASK BODY HAVING VERTICALLY STITCHED NOSE ACCOMODATING PORTION

FIELD OF THE INVENTION

The present invention relates to a mask able to appropriately cover the nose, and particularly to a face mask having a downward, concave flange produced by suitably folding the two side portions of the upper portion of the body of the mask downwardly towards the center of the mask.

BACKGROUND OF THE INVENTION

The purpose of a face mask is to sufficiently cover one's mouth and nose. However, since various configurations of the portions being covered exist, sufficient covering of the mouth and the nose is, in fact, difficult. It is the purpose of the present invention to provide a mask which will sufficiently and appropriately cover the nose of a person wearing such mask.

SUMMARY OF THE INVENTION

Accordingly, the present invention is provided to solve the aforementioned problem, and to provide a mask able to appropriately cover the nose of a person.

Also, an object of the present invention is to provide a mask which will reduce the obstruction of the wearer's vision caused by wearing a mask. This is accomplished because the mask of the present invention has an upper flange which fits closely over the nose ridge and thereby avoids obstructing the wearer's vision. Furthermore, the distance that the mask protrudes beneath the eyes of the wearer is decreased, and therefore, the danger and inconvenience caused by an obstruction of vision can be greatly reduced.

DETAILED DESCRIPTION OF THE INVENTION AND THE PREFERRED EMBODIMENT

Figure 1:
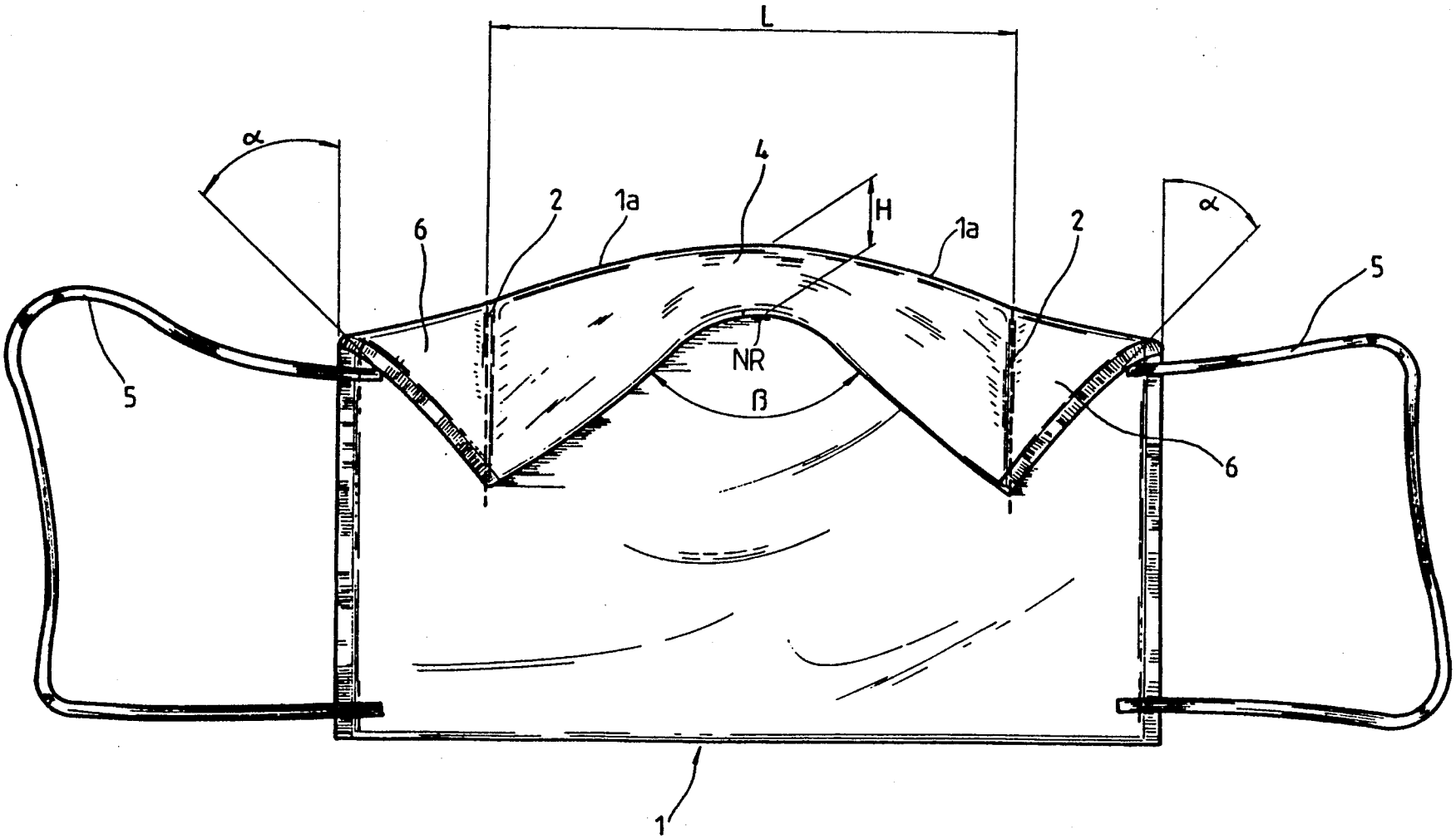
FIG. 1 is a plan view of the invention.

The mask of the present invention is made, at first, by wrapping a sheet of gauze inside soft polyurethane material and thereafter stitching the soft polyurethane material around and to the gauze sheet to form the mask body (1) so as to have a rectangular shape. An upper portion (1*a*) of the mask body (1) is then folded downwardly by folding the two opposing side portions (6) of the upper portion (1*a*) toward the center of the mask body. The right and left edges of the folded side portions (6) form angles ($\alpha$) to the right and left edges of the mask body (1). Thereafter, the folded side portions (6) are stitched to the mask body (1) along stitching lines (2) an appropriate distance (L) apart. Thus, a flange (4) having an inverted, concave, V-shaped configuration is formed between the right and left stitching lines (2). A pair of resilient rings (5) are then affixed to the body (1) of the mask so as to complete the construction of the invention.

Figure 2:
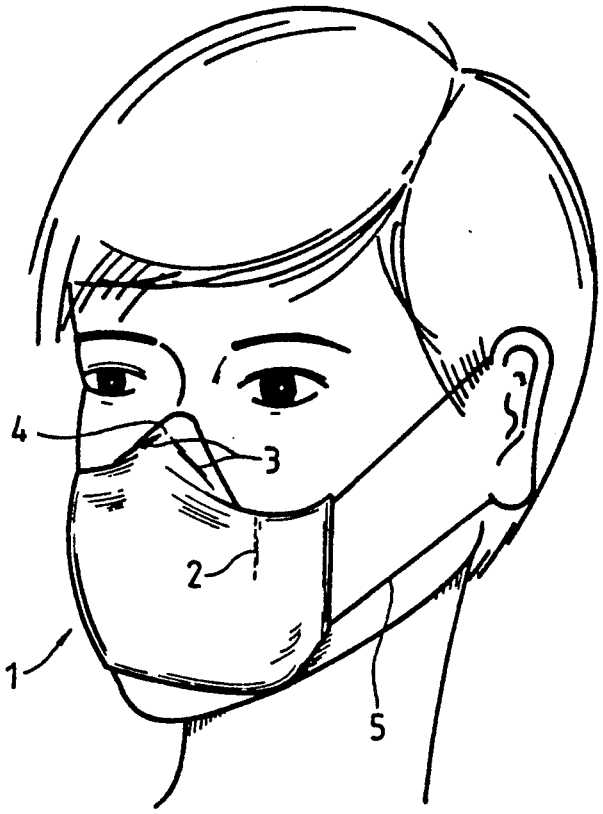
FIG. 2 shows an in-use embodiment of the invention when it is worn on the face of a user.
Figure 3:
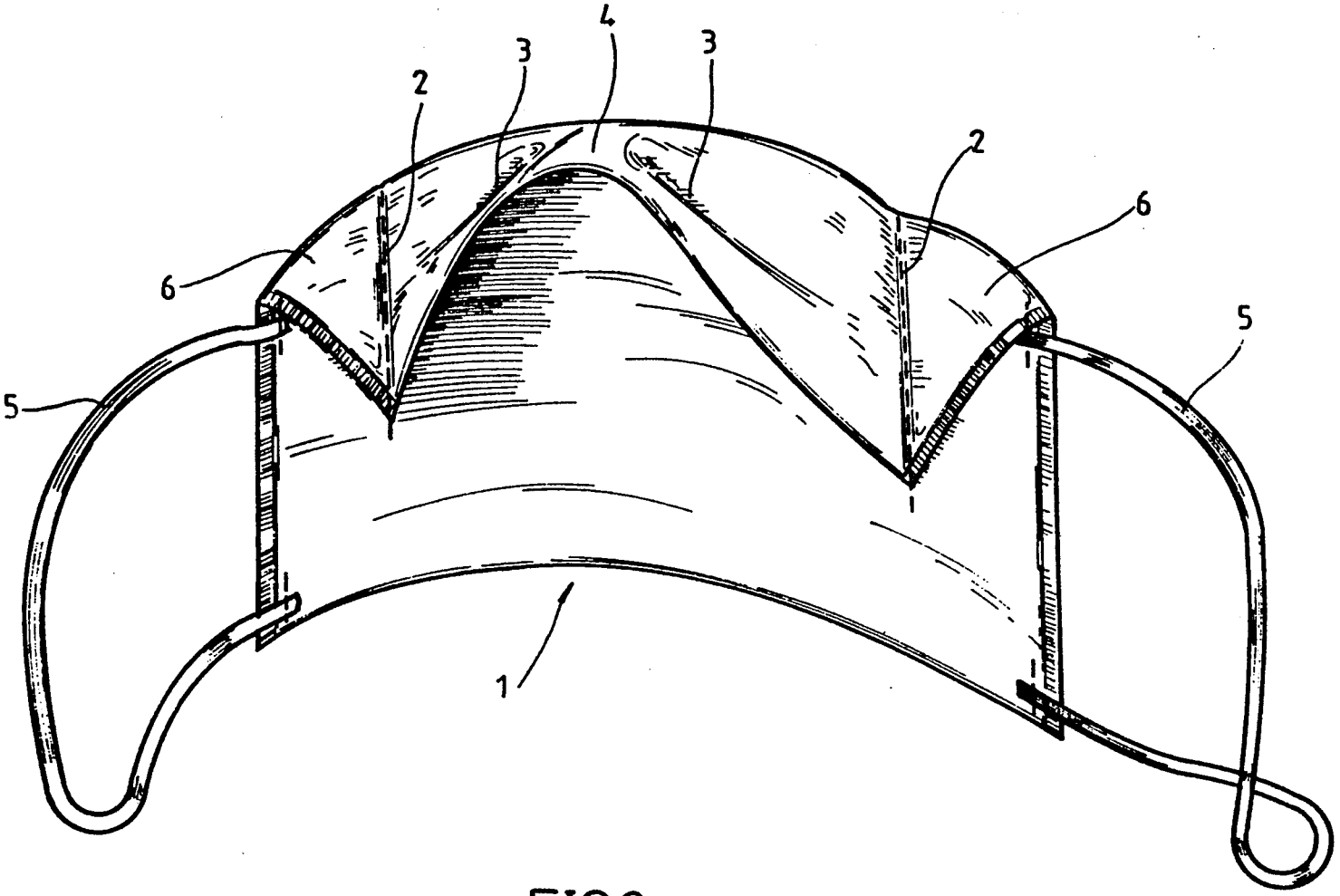
FIG. 3 is a perspective view of the mask of the present invention showing the configuration of the mask when worn.

The mask of the present invention is worn on the face of the user as shown in FIG. 2. With reference to FIG. 3, when the mask is worn, the inverted, V-shaped flange provides a space for accommodating the nose of the wearer of the mask. By virtue of the tension caused by the nose ridge portion (NR) which presses against the edge of the center of the flange (4), the side-edges of the flange (4) are drawn or pulled upwards and thus folds (3) are formed in the area covering the nose. The folds (3) produce a force pressing inwardly upon the flange (4) so as to press upon both sides of the nose of the wearer to thereby create an automatic close fit of the mask to the nose of the wearer.

THE PRINCIPLE OF THE PRESENT INVENTION

The purpose of the present invention is to provide a flange (4) having a downward, concave configuration, wherein:

1. The two sides of the flange (4) should be folded to a suitable angle ($\beta$) and thereby, upon pressing the edge of the center of the flange against the nose ridge, the edges of both sides of the flange (4) are pulled upwards along the sides of the nose to thereby cover the nose completely. The height (H) of folding at the center of the flange (4) should be able to cover the tip of the nose. The folding angle ($\beta$) is relative to the distance (L) between the right and left stitching lines (2), so that the longer the distance (L), the larger the folding angle ($\beta$).

2. The body (1) of the mask should be made of flexible material, so that the flange (4) can appropriately cover the nose with the inward pressure produced by the folds (3) when the mask is being worn.

3. The applicable or suitable range for covering the nose is determined by the height (H) of flange (4) and the distance (L) between the right and left stitching lines (2). It is preferable that such an applicable range should be made as large as possible so as to fit a larger nose. As mentioned above, covering of the sides of the nose by the edges of flanges (4) is automatically performed by the pressure produced by the folds (3):

(i) Increasing of the distance (L) between the right and left stitching lines (2) will increase the range of nose coverage. However, in the case that the distance (L) between the stitching lines (2) becomes too long, the covering force produced by the edges of the flange (4) will be reduced, and will not render an appropriate fit.

(ii) The angles ($\alpha$) at the sides of the body (1) are relative to the downward folding angle ($\beta$) of the flange (4) When the angles ($\alpha$) are larger, the downward folding angle ($\beta$) will be smaller. With the same height (H), a larger angle ($\beta$) of the flange (4) will cause flange (4) to produce a relatively greater tensile force against the wearer's nose ridge, thereby creating a tighter fit. However, if angle ($\beta$) becomes excessively large, the center of the flange (4) will be wrinkled and the appropriate fitting of the covering of the nose will be hindered.

The aforementioned description explicates the techniques of producing the present invention. Not only is the manufacturing procedure simple, but such a design has a wide range of applications. Anyone who modifies the invention within its spirit should still be considered as falling within the scope of the invention. The scope of the invention is hereinafter defined by the following claim.

What is claimed is:

1. A face mask comprising in combination:

a rectangular body made of a flexible sheet material, said rectangular body having an upper portion which includes two opposing side portions, each of said side portions being folded downwardly toward the center of said body and stitched onto said body to form a flange having an inverted, concave, V-shaped configuration which provides a space for accommodating the nose of the wearer of the mask.

* * * * *